US005906171A

United States Patent [19]

Kristensen et al.

[11] Patent Number: 5,906,171

[45] Date of Patent: May 25, 1999

[54] FLOATING RUNWAY

[75] Inventors: Per Herbert Kristensen, Afne Kolsås; Lars Martin Sørhaug, Slemmestad, both of Norway

[73] Assignee: Kvaerner Maritime as, Lysaker, Norway

[21] Appl. No.: 08/875,087

[22] PCT Filed: Jan. 29, 1996

[86] PCT No.: PCT/NO96/00018

§ 371 Date: Sep. 24, 1997

§ 102(e) Date: Sep. 24, 1997

[87] PCT Pub. No.: WO96/23691

PCT Pub. Date: Aug. 8, 1996

[30] Foreign Application Priority Data

Jan. 30, 1995 [NO] Norway ..... 950350

[51] Int. Cl.[6] ..... B63B 35/00

[52] U.S. Cl. ..... 114/261

[58] Field of Search ..... 114/261, 262, 114/263–267; 14/26, 27, 2.8

[56] References Cited

U.S. PATENT DOCUMENTS

| | | | |
|---|---|---|---|
| 1,854,336 | 4/1932 | King . | |
| 2,399,611 | 5/1946 | Armstrong . | |
| 2,430,178 | 11/1947 | Kurfiss | 114/266 |
| 3,763,808 | 10/1973 | Smith , Jr. | 114/266 |
| 3,788,254 | 1/1974 | Sheil . | |
| 4,393,533 | 7/1983 | Terrien et al. . | |
| 4,487,151 | 12/1984 | Deiana . | |
| 5,398,635 | 3/1995 | Tellington . | |

FOREIGN PATENT DOCUMENTS

| | | | |
|---|---|---|---|
| 3630275A1 | 3/1988 | Germany . | |
| 216386 | 8/1990 | Japan | 114/264 |
| 2241925 | 9/1991 | United Kingdom . | |

*Primary Examiner*—Ed L. Swinehart

*Attorney, Agent, or Firm*—Birch, Stewart, Kolasch & Birch, LLP

[57] ABSTRACT

A floating runway is provided for use at sea having a horizontal, top surface whereupon aircraft may operate during landing and take-off. A number of floating, releasably interconnected supporting section are connected to a number of bridge sections mounted alternately and consecutively in a longitudinal direction of the runway. The number of supporting sections and the number of bridge sections include ends, as viewed in the logitudinal direction of the runway having respective abutment portions adapted for mutual abutment for interconnection of the section. The abutment portions including cantilevered beam portions projecting away from mid portions of the respective sections as reviewed in the longitudinal direction thereof. The beam portions of the bridge sections include a lower surface and an upper surface of the beam portions of the supporting sections arranged the same distance from the top surface. The beam portions of the bridge sections are supported by the beam portions of the supporting sections via the beam portions of the bridge sections and carry only a portion of the weight of the bridge sections when the bridge sections are connected with the supporting sections, so that the weight portion provides an abutment force for ensuring the mutual fixation of the sections.

6 Claims, 1 Drawing Sheet

FLOATING RUNWAY

BACKGROUND OF THE INVENTION

1. Field of the Invention

The invention concerns a floating runway at sea with a substantially horizontal upper surface, on which aircraft can be operated during landing and takeoff.

2. Description of Background Art

From the prior art there are known aircraft carriers which comprise a runway at sea for aircraft.

This runway, however, is so short that only relatively small planes can take off and land even though aids are employed for acceleration and retardation of the planes when they take off and land respectively.

As a result of growing resistance to the building of large airports on land, due, amongst other reasons, to the strains on the environment which are involved, the difficulties of finding areas which are suitable for the purpose, e.g. close to centers of population etc., airports have been built on islands, which have been levelled, possibly raising the ground around the islands by filling with stones etc. This, however, depends on the existence of suitable islands or shallow waters in the area where an airport is required.

Aircraft carriers on the other hand can be more easily positioned and orientated. Even though at present very large ships can be built, it would appear, however, that the operation of an aircraft carrier with a runway which is large enough to be used by, e.g. large transport planes, may be problematic.

In order to obtain an acceptable length and price for such a ship, separate take-off and landing aids would probably have to be employed, which can entail limitations with regard to types of cargo. Thus it is possible that the transport of animals and the simple transport of other delicate cargo could be difficult. Moreover it appears to be doubtful whether the routine use of such ships and aids will be accepted for large passenger planes.

SUMMARY AND OBJECTS OF THE INVENTION

Runways at sea with a length of, e.g. 1500 m–3000 m are therefore required.

The object of the invention is to provide an aircraft runway which can be provided at sea, and whose length is so great that it can be used without difficulties for large transport planes and passenger planes.

The characteristics of the runway according to the invention are indicated in the features of the claims presented.

BRIEF DESCRIPTION OF THE DRAWINGS

The invention will now be described in more detail with reference to the drawing which schematically illustrates an embodiment of a runway according to the invention.

DETAILED DESCRIPTION OF THE PREFERRED EMBODIMENTS

Figure 1:
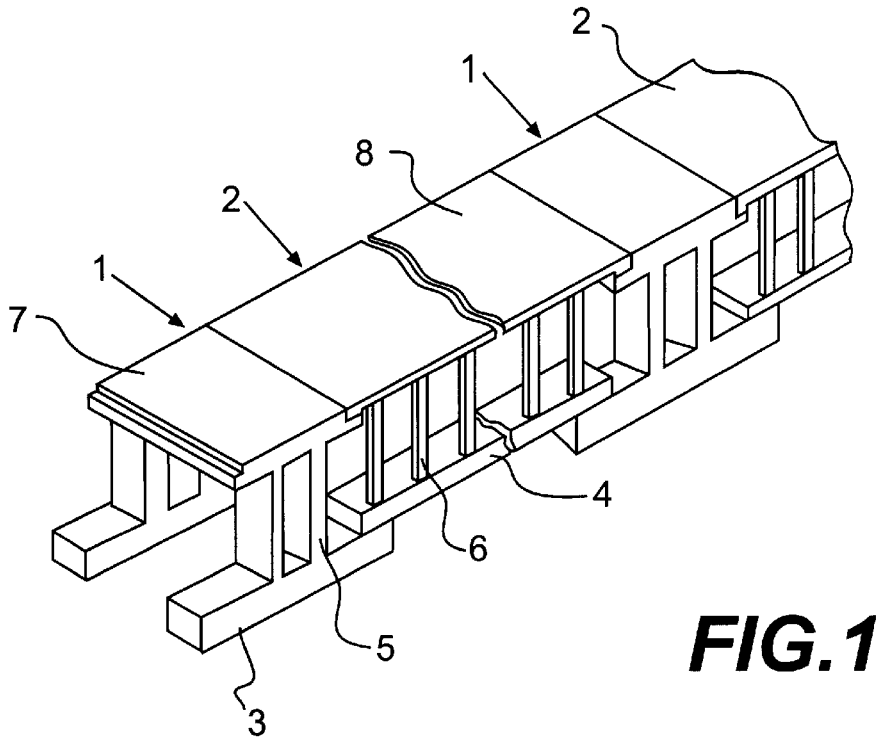
FIG. 1 is a perspective view of a runway according to the invention where sections of the runway have been cut away.

The runway which is illustrated in FIG. 1 comprises supporting sections 1 and bridge sections 2 arranged alternately in the runway's longitudinal direction.

Figure 2:
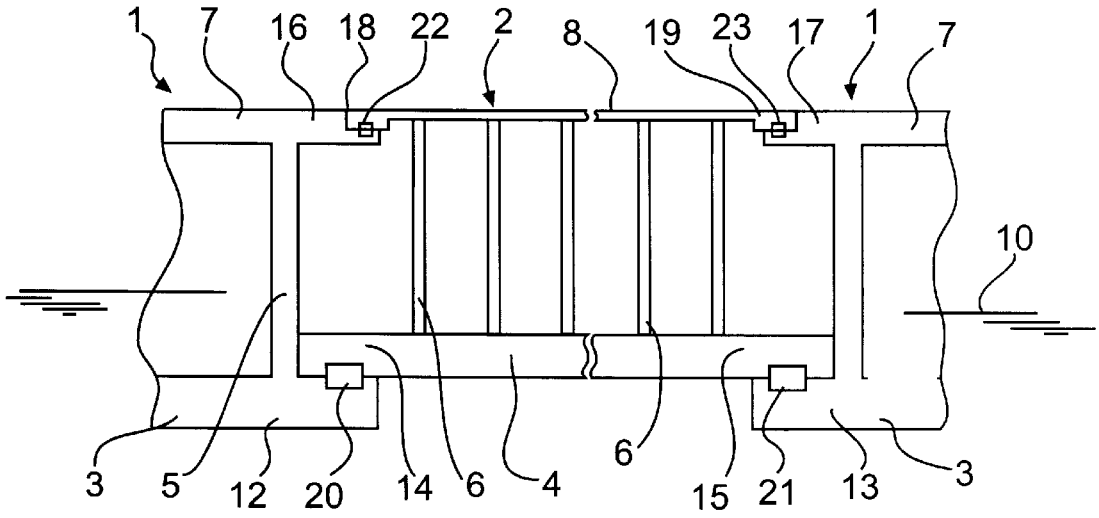
FIG. 2 is a side view on a larger scale of the runway illustrated in FIG. 1, sections having been cut away.

In the lower parts of the supporting sections 1 and the bridge sections 2 there are floating section 3 and 4 respectively which are hollow and can be ballasted in such a manner that the section's draught can be adjusted. A waterline is indicated in FIG. 2 by the reference numeral 10.

Up from the supporting sections' and the bridge sections' floating sections 3 and 4 respectively there extend a number of braces or struts 5 and 6 respectively to decks 7 and 8 respectively on whose upper surface aircraft can operate during take-off or landing. The struts 5,6 are preferably also in the form of floating bodies.

The supporting sections 1 are designed in the same way as known per se semi-submersible platforms, and the bridge sections 2 are trusswork structures with a certain degree of flexibility.

The bridge section's floating section is preferably composed of two floating bodies which extend in the runway's longitudinal direction and are arranged on each side of the bridge section. These can be ballasted in such a manner that the runway extends substantially linearly and horizontally.

At each end, considered in the runway's longitudinal direction, the supporting sections' floating sections 3 have lower abutment devices 12,13, which are arranged to work together with and support corresponding lower abutment devices 14,15 of the bridge sections' floating sections 4.

Similarly at each end, considered in the runway's longitudinal direction, the supporting sections' deck 7 can have upper abutment devices 16,17 which are arranged to work together with and support corresponding upper abutment devices 18,19 of the bridge sections' deck 8.

The lower abutment devices 12,13,14,15 can comprise lower connecting devices 20,21, whereby the supporting sections 1 and the bridge sections 2 can be rigidly connected to one another, thereby ensuring that adjacent bridge sections and supporting sections are secured against movement in the vertical plane and the horizontal plane.

Furthermore the upper abutment devices 16,17,18,19 can comprise upper abutment devices 22,23, whereby the supporting sections and the bridge sections 2 can be connected to one another.

The upper connecting devices 22,23 of the supporting sections 1 and the bridge sections 2 can be designed in such a manner that they permit interconnection without bending moments or torsion moments being transferred between the sections. This can be achieved by means of an overlapping, sliding structure which compensates for a pitching movement between the sections.

Alternatively the upper connecting devices 22,23 can also provide a rigid connection between the sections 1,2.

The bridge sections 2 can be connected with the supporting sections 1 by having the supporting sections 2 ballasted and submerged to such an extent in relation to the bridge sections 2 that each bridge section 2 can initially be floated in between two adjacent supporting sections 1. The supporting sections' ballast is then reduced, thus reducing the supporting sections' draught and the supporting sections' lower abutment sections 12,13 and possibly also the upper abutment sections 16,17, if these are provided, abut against corresponding lower abutment sections 14,15 and possibly upper abutment sections 22,23 of the bridge section 2.

Alternatively the supporting sections' draught remains unaltered. In this case in order to connect the supporting sections and the bridge sections together, the bridge sections' draught is initially reduced by reduction of their ballast, whereupon the supporting sections are floated in between adjacent bridge sections. The ballast and the draught of the bridge sections is then increased, thus causing abutment sections of the bridge sections and the supporting sections to abut against one another and the sections are connected to one another.

The force with which the bridge sections 2 abut against the supporting sections 1 is so great that the connection between the bridge sections and the supporting sections is guaranteed at all times. In this connection the waterline area and the displacement of the bridge sections 2 are so dimensioned that varying loads, e.g. due to alterations in buoyancy as a result of heavy seas and other strains on the sections do not reduce the force whereby the bridge sections abut against the supporting sections to such an extent that the connection between the sections is weakened and unacceptable mechanical stresses are exerted.

The bridge sections 2 are elastic, and thus yield to some extent if adjacent supporting sections 1 are mutually rotated about the runway's longitudinal axis, possibly also about the runway's transversal axis and/or height axis, or these supporting sections are displaced vertically in relation to one another.

The connecting devices 20–23 are easily releasable, thus enabling the sections 1,2 to be speedily connected or disconnected if, e.g. the weather conditions should so indicate. After a disconnection of this kind the runway can be rapidly moved.

We claim:

1. A floating runway for use at sea having a horizontal, top surface whereupon aircraft may operate during landing and take-off, comprising:

a number of floating, releasably interconnected supporting section;

a number of bridge sections mounted alternately and consecutively in a longitudinal direction of the runway;

said number of supporting sections and said number of bridge sections include ends, as viewed in the logitudinal direction of the runway having respective abutment portions adapted for mutual abutment for interconnection of the section;

the abutment portions including cantilevered beam portions projecting away from mid-portions of the respective sections as viewed in the longitudinal direction thereof;

the beam portions of the bridge sections include a lower surface and an upper surface of the beam portions of the supporting sections arranged the same distance from the top surface; and the beam portions of the bridge sections are supported by the beam portions of the supporting sections via the beam portions of the bridge sections and carry only a portion of the weight of the bridge sections when the bridge sections are connected with the supporting sections, whereby the weight portion provides an abutment force for ensuring the mutual fixation of the sections.

2. The floating runway according to claim 1, wherein the abutment portions include connecting devices for mutual rigid interconnection of the sections, each of the connecting devices having an element simultaneously conformingly jutting into recesses provided in cooperating beam portions of a bridge section and a support section, respectively, the recesses having openings facing each other.

3. A method for the production of a floating runway at sea having a horizontal top surface whereupon aircraft may operate during landing and takeoff, comprising:

providing a number of floating, releasably interconnected supporting sections and bridge sections mounted alternately and consecutively in a longitudinal direction of the runway, said supporting sections and bridge sections including ends as viewed in the longitudinal direction of the runway with respective abutment portions adapted to mutual abutment to interconnect the section;

providing ballasting sections constituting the supporting sections and reducing ballast of sections which constitute the bridge sections, thereby bringing abutment portions of the supporting sections to a lower level than abutment portions of the bridge section;

arranging bridge sections relative to the supporting sections in such a way that the abutment portions of the supporting sections are located directly below the abutment portions of the bridge sections, and removing ballast from the supporting sections and ballasting the bridge sections, thereby bringing the abutment portions of the bridge sections to rest upon the abutment portions of the supporting sections with a portion of the weight of the bridge sections and ensuring the interconnection of the sections.

4. A floating runway for use at sea having a horizontal, top surface whereupon aircraft may operate during landing and take-off, comprising:

a plurality of floating, releasably interconnected supporting sections;

a plurality bridge sections mounted alternately and consecutively in a longitudinal direction of the runways;

said plurality of supporting sections and said plurality of bridge sections include ends, as viewed in the longitudinal direction of the runway having respective abutment portions adapted for mutual abutment for interconnection of the section, the abutment portions including cantilevered beam portions projecting away from the mid-portion as viewed in the longitudinal direction thereof;

the beam portions of the bridge sections include a lower surface and an upper surface of the beam portions of the supporting sections arranged the same distance from the top surface; and the beam portions of the bridge sections are supported by the beam portions of the supporting sections via the beam portions of the bridge sections and carry only a portion of the weight of the bridge sections when the bridge sections are connected with the supporting sections, whereby the weight portion provides an abutment force for ensuring the mutual fixation of the sections.

5. The floating runway according to claim 4, wherein the abutment portions include connecting devices for mutual rigid interconnection of the sections, each of the connecting devices having an element simultaneously conformingly jutting into recesses provided in cooperating beam portions of a bridge section and a supporting section respectively, the recesses having openings facing each other.

6. A method for the production of a floating runway at sea having a horizontal top surface whereupon aircraft may operate during landing and takeoff, comprising:

providing a number of floating, releasably interconnected supporting sections and bridge sections mounted alternately and consecutively in a longitudinal direction of the runway, said supporting section and bridge sections including ends as viewed in the longitudinal direction of the runway with respective abutment portions adapted to mutual abutment to interconnect the section;

providing ballasting sections constituting the supporting sections reducing ballast of sections which constitute the bridge sections, thereby bringing abutment portions of the supporting sections to a lower level than abutment portions of the bridge section;

arranging bridge sections relative to the supporting sections in such a way that the abutment portions of the supporting sections are located directly below the abutment portions of the bridge sections; and removing ballast from the supporting sections or ballasting the bridge sections, thereby bringing the abutment portions of the bridge section to rest upon the abutment portion of the supporting sections with a portion of the weight of the bridge sections and ensuring the interconnection of the sections.

* * * * *